US006165412A

United States Patent [19]

Lunk et al.

[11] Patent Number: 6,165,412

[45] **Date of Patent: *Dec. 26, 2000**

[54] METHOD OF MAKING NON-SAG TUNGSTEN WIRE FOR ELECTRIC LAMPS

[75] Inventors: Hans-Joachim Lunk, Towanda, Pa.; Michael Salmen, Brandenburg, Germany; Henry J. Stevens, Athens, Pa.

[73] Assignee: Osram Sylvania Inc., Danvers, Ohio

[ * ] Notice: This patent is subject to a terminal disclaimer.

[21] Appl. No.: 09/390,201

[22] Filed: Sep. 7, 1999

[51] Int. Cl.[7] ..... B22F 1/02

[52] U.S. Cl. ..... 419/4; 419/28; 419/34; 419/35; 419/38

[58] Field of Search ..... 419/4, 34, 38, 419/35, 28

[56] References Cited

U.S. PATENT DOCUMENTS

| | | | |
|---|---|---|---|
| 1,082,933 | 12/1913 | Coolidge . | |
| 1,226,470 | 5/1917 | Coolidge . | |
| 1,410,499 | 3/1922 | Pacz . | |
| 3,853,492 | 12/1974 | Millner et al. | 29/182 |
| 3,927,989 | 12/1975 | Koo | 29/182.5 |
| 4,971,757 | 11/1990 | Day et al. | 519/23 |
| 5,019,330 | 5/1991 | Bewlay et al. | 419/39 |
| 5,072,147 | 12/1991 | Pugh et al. | 313/341 |
| 5,087,299 | 2/1992 | Fukuchi et al. | 148/11.5 |
| 5,284,614 | 2/1994 | Chen et al. | 419/20 |
| 5,785,731 | 7/1998 | Fait et al. | 75/368 |
| 5,795,366 | 8/1998 | Salmen et al. | 75/368 |

OTHER PUBLICATIONS

1 K. Hara et al., The Development of High Quality Tungsten Wire for High Stress Halogen Lamp, Nippon Tungsten Review 29 (1997) pp. 20–29.

2 H.–J. Lunk et al., What is Behind "Tungsten Blue Oxides"?, Refractory Metals & Hard Materials 12 (1993–1994) pp. 17–26.

3 H.–J. Lunk et al., Solid State 1H NMR Studies of Different Tungsten Blue Oxides and Related Substances, Refractory Metals, & Hard Materials 16 (1198) pp. 3–30.

*Primary Examiner*—Daniel J. Jenkins
*Attorney, Agent, or Firm*—Robert F. Clark

[57] ABSTRACT

A method of making a potassium-doped tungsten powder is described comprising forming a mixture of ammonium paratungstate or ammonium metatungstate and a potassium-containing compound selected from a thermally unstable potassium-containing salt or a potassium tungstate, and reducing the mixture in a single step without adding additional dopants to form a potassium-doped tungsten powder. The potassium-doped tungsten powder produced by the method of this invention can be pressed, sintered and drawn to produce a non-sag tungsten wire.

12 Claims, No Drawings

METHOD OF MAKING NON-SAG TUNGSTEN WIRE FOR ELECTRIC LAMPS

CROSS REFERENCE TO RELATED APPLICATIONS

This application is related to commonly assigned application Ser. No. 09/391,121, filed Sep. 7, 1999 now allowed.

TECHNICAL FIELD

This invention relates to non-sag tungsten wire for use as filaments in electric lamps. In another aspect, this invention relates to methods of making potassium-doped tungsten powder for non-sag tungsten wire.

BACKGROUND ART

The metallurgy of tungsten plays a central role in the development of lamp filaments. Tungsten wire is made in various stages in accordance with the well-known Coolidge method introduced in 1910; U.S. Pat. No. 1,082,933 (1913) and U.S. Pat. No. 1,226,470 (1917).

Pure tungsten wire is not suitable to make filaments for incandescent lamps. Under typical operating conditions, the individual grains of the filament have the tendency to offset, or slide off (creep or sag) with respect to each other. This causes the filament to sag and short out. A lamp made with such filaments will, therefore, fail prematurely. The beneficial effects of doping to improve the creep resistance of tungsten wire were recognized as early as 1910, and doping was practiced henceforth. Systematic doping of tungsten oxide powder with potassium-containing chemicals was patented by Pacz in 1922, U.S. Pat. No. 1,410,499. Non-sag (NS) tungsten wire is unique in that it is a composite between two mutually insoluble metals, tungsten and potassium. The non-sag properties are attributed to longitudinal rows of sub-microscopic bubbles containing liquid and/or gaseous potassium.

The long chain of processes in a standard powder metallurgical (P/M) manufacturing of potassium-doped tungsten wire starts with the partial reduction of ammonium paratungstate tetrahydrate (APT), $(NH_4)_{10}[H_2W_{12}O_{42}].4H_2O$, in hydrogen or hydrogen/nitrogen, to produce 'tungsten blue oxide' (TBO). The composition of the blue-colored TBO, having the general formula $xNH_3.yH_2O.WO_n$ ($0<x<0.1$, $0<y<0.2$, and $2.5<n<3.0$), depends on the reduction conditions of APT such as temperature, atmosphere, type of rotary kiln or pusher-type furnace and feed rate through the furnace. Along with crystalline compounds ($WO_3$, $W_{20}O_{58}$, $W_{18}O_{49}$, $WO_2$ and hexagonal tungsten bronze phases, $A_xB_yWO_3$ ($A=NH_4$, $H_3O$; $B=NH_3$, $H_2O$; $0<x+y<0.33$)), industrially produced TBO powders may contain up to 50% of amorphous phases. The TBO is doped with aqueous solutions of potassium silicate (1500–2500 ppm K, 1500–2500 ppm Si) and aluminum nitrate (or aluminum chloride) (~300 ppm Al). It is then dried and milled. The doped TBO is then reduced in hydrogen to metal powder. By some manufacturers, a separate "browning" step (reduction to ~'$WO_1$') is used. The doped tungsten powder is washed first with water, then with hydrofluoric and hydrochloric acid to remove unnecessary and undesired amounts of dopants. The powder is then dried in air. Appropriate powder blends are made to give a potassium content of >90 ppm in an acid-washed sample of powder. The washed powder is then mechanically or isostatically pressed and sintered by high-temperature resistance sintering at above 2900° C. The ingots which have a density of >17.0 g/cm$^3$ and a K content of >60 ppm are rolled or swaged, and finally drawn into wire.

The multi-step process leads to the outstanding high-temperature creep resistance of NS tungsten wire. It is generally recognized that the NS tungsten wire should have a potassium content of at least 60 ppm. Furthermore, it has been proposed that a potassium content of 80 ppm or higher, and in particular 85–110 ppm K, is necessary for high performance NS tungsten wire. See, e.g., K. Hara, et al., The Development of High Quality Tungsten Wire for High Stress Halogen Lamp, Nippon Tungsten Review 29 (1997), pp. 20–29.

The silicon and aluminum added to the TBO in the standard method serve exclusively as 'helpers' during the reduction and sintering stages. After high-temperature sintering their concentration is reduced to less than 10 ppm each. Neither element plays any positive role in the final NS tungsten wire. In addition, the number of steps in the standard process makes the process inefficient and the process further produces a contaminated acid waste, which must be properly disposed of. Hence, it would advantageous to have a more efficient method of making NS tungsten wire, which used fewer processing steps and did not produce an acid waste.

SUMMARY OF THE INVENTION

It is an object of the invention to obviate the disadvantages of the prior art.

It is another object of the invention to provide a simpler method of producing non-sag tungsten for use in lighting applications.

It is a further object of the invention to provide a lower cost, less environmentally sensitive method for producing non-sag tungsten.

In accordance with one aspect of the invention, there is provided a method of making a potassium-doped tungsten powder.

The method comprises forming a mixture of ammonium paratungstate or ammonium metatungstate and a potassium-containing compound selected from a thermally unstable potassium-containing salt or a potassium tungstate, and reducing said mixture in a single step (single step reduction) to form a potassium-doped tungsten powder.

In accordance with another aspect of the invention, the method further includes forming the potassium-doped tungsten powder into a pressed compact and sintering the pressed compact at a temperature from about 1600° C. to about 2000° C.

DESCRIPTION OF THE PREFERRED EMBODIMENTS

For a better understanding of the present invention, together with other and further objects, advantages and capabilities thereof, reference is made to the following disclosure and appended claims.

The present invention involves the dry doping of ammonium paratungstate tetrahydrate (APT), $(NH_4)_{10}[H_2W_{12}O_{42}].4H_2O$ and ammonium metatungstate hydrate (AMT), $(NH_4)_6[H_2W_{12}O_{40}].nH_2O$ with potassium-containing salts and a subsequent single step reduction of the mixture in hydrogen to yield potassium-doped tungsten powders. Preferably, the reduction is performed at temperatures from about 500° C. to about 1000° C. As used herein, the term single step reduction means that the reduction is not interrupted to include an additional doping step. The single step reduction does not exclude using multiple firing conditions (time/temperature/atmosphere) during the reduction step.

The potassium-doped tungsten powders are usable directly in the standard P/M manufacturing of tungsten wire for incandescent lamps without acid washing. The preferred potassium salts used in this invention are potassium nitrate, $KNO_3$, and potassium nitrite, $KNO_2$, although it is anticipated that any thermally unstable potassium-containing salt or any one of a number of different potassium tungstates may be used as a doping compound. For example, potassium carbonate, $K_2CO_3$, or potassium hydrogencarbonate, $KHCO_3$, and also potassium tungstates, $K_2W_nO_{3n+1}$ (n=1 to 8), can be useful as doping compounds.

Another novel feature of the invention is that the potassium-doped tungsten may be sintered into dense ingots at distinctly lower temperatures than the prior art processes. In particular, the potassium-doped tungsten powder may be sintered at temperatures from about 1600° C. to about 2000° C. The process of this invention enables the production of sintered tungsten ingots containing potassium in amounts up to 120 ppm and densities higher than 17.0 g/cm$^3$.

The novel process eliminates the prior art steps of wet doping TBO with aluminum- and silicon-containing chemicals, drying and milling of the doped TBO, acid washing of the tungsten powder, and high sintering temperatures. As a result the process is more economical and less harmful to the environment.

The following non-limiting examples are presented.

EXAMPLE 1

Three thousand grams of reagent grade APT ('Medium APT' with sifting characteristics of 15 to 25% −325 mesh and 30 to 40% −200 mesh) was carefully blended with 4.8 g of ground potassium nitrate, $KNO_3$. First, the total amount of $KNO_3$ was added to 100 g of the APT in a 125 ml plastic bottle and homogenized on a roller blender for two hours. Then the mixture was transferred into a 500 ml plastic bottle, mixed with 500 g of APT and rolled for another two hours. The final blending step was provided in a 2 l plastic bottle by mixing the intermediate blend with the remaining 2400 g of APT and rolling the powders for two hours.

Three hundred gram samples of potassium-doped APT were reduced in a laboratory LINDBERG furnace in an 11" Inconel boat under the following conditions: 30 cfh dry hydrogen, a heating rate of 6 K/min, a one hour hold at 550° C. and a final one hour reduction time at 900° C. The tungsten powder was then mechanically pressed into 9 g compacts and sintered in hydrogen at 1800° C. for six hours.

EXAMPLE 2

Sintered compacts of NS tungsten were prepared as in Example 1 except that 7.8 g of dried and ground potassium tungstate, $K_2WO_4$, was used in place of potassium nitrate.

EXAMPLE 3

Sintered compacts of NS tungsten were prepared as in Example 1 except that AMT was used in place of APT.

The characteristics of the potassium-doped tungsten powders and sintered compacts are given in Table 1. As can be seen, water washing of the doped tungsten powder significantly reduced the amount of potassium. However, the potassium retention of the sintered compact did not depend on whether the doped tungsten powder was or was not water washed prior to sintering. Nor was there any significant difference between the measured densities of the sintered compacts made with unwashed tungsten powder (unwashed) and the ones made with water washed tungsten powder (washed).

TABLE 1

| | FSSS (μm) | | Potassium (ppm) | | | | Hg density (g/cm$^3$) | |
|---|---|---|---|---|---|---|---|---|
| Sample | Unwashed Powder | Water Washed Powder | Unwashed Powder | Sintered Compact (Unwashed) | Water Washed Powder | Sintered Compact (Washed) | Sintered Compact (Unwashed) | Sintered Compact (Washed) |
| 3000 g APT + 4.8 g $KNO_3$ | 1.75 | 1.70 | 242 | 120 | 179 | 121 | 17.4 | 17.5 |
| 3000 g APT + 7.8 g $K_2WO_4$ | 1.67 | 1.63 | 238 | 80 | 108 | 82 | 17.5 | 17.6 |
| 3000 g AMT + 4.8 g $KNO_3$ | 1.48 | 1.42 | 165 | 49 | 85 | 49 | 18.0 | 18.2 |

While there has been shown and described what are at the present considered the preferred embodiments of the invention, it will be obvious to those skilled in the art that various changes and modifications may be made therein without departing from the scope of the invention as defined by the appended claims.

We claim:

1. A method of making a potassium-doped tungsten powder comprising:

forming a dry mixture of ammonium paratungstate or ammonium metatungstate and a potassium-containing compound selected from a thermally unstable potassium-containing salt or a potassium tungstate; and reducing said mixture in a single step to form a potassium-doped tungsten powder.

2. The method of claim 1 wherein the thermally unstable potassium-containing salt is potassium nitrate, potassium nitrite, potassium carbonate or potassium hydrogencarbonate.

3. The method of claim 1 wherein the potassium-containing compound is a potassium tungstate having a general formula $K_2W_nO_{3n+1}$, where n is from 1 to 8.

4. The method of claim 1 wherein the mixture is reduced in a hydrogen-containing atmosphere at a temperature from about 500° C. to about 1000° C.

5. The method of claim 1 wherein the potassium-containing compound is potassium nitrate or $K_2WO_4$.

6. The method of claim 5 wherein the mixture is reduced in a hydrogen-containing atmosphere at a temperature from about 500° C. to about 1000° C.

7. A method of making a sintered compact of non-sag tungsten comprising:

forming a dry mixture of ammonium paratungstate or ammonium metatungstate and a potassium-containing compound selected from a thermally unstable potassium-containing salt or a potassium tungstate;

reducing said mixture in a single step to form a potassium-doped tungsten powder;

forming the potassium-doped tungsten powder into a pressed compact; and sintering the pressed compact at a temperature from about 1600° C. to about 2000° C.

8. The method of claim 7 wherein the thermally unstable potassium containing salt is potassium nitrate, potassium nitrite, potassium carbonate or potassium hydrogencarbonate.

9. The method of claim 7 wherein the potassium-containing compound is a potassium tungstate having a general formula $K_2W_nO_{3n+1}$, where n is from 1 to 8.

10. The method of claim 7 wherein the mixture is reduced in a hydrogen-containing atmosphere at a temperature from about 500° C. to about 1000° C.

11. The method of claim 7 wherein the potassium-containing compound is potassium nitrate or $K_2WO_4$.

12. The method of claim 11 wherein the mixture is reduced in a hydrogen-containing atmosphere at a temperature from about 500° C. to about 1000° C.

* * * * *